US007625318B1

(12) United States Patent
Heyn

(10) Patent No.: US 7,625,318 B1
(45) Date of Patent: Dec. 1, 2009

(54) EXERCISE APPARATUS

(76) Inventor: Steven Heyn, 235 Flocktown Rd., Long Valley, NJ (US) 07853

( * ) Notice: Subject to any disclaimer, the term of this patent is extended or adjusted under 35 U.S.C. 154(b) by 799 days.

(21) Appl. No.: 10/877,023

(22) Filed: Jun. 28, 2004

(51) Int. Cl.
*A63B 21/00* (2006.01)

(52) U.S. Cl. ..... 482/62; 482/5; 482/100

(58) Field of Classification Search ..... 482/45, 482/46, 49, 44, 55, 79, 80, 114–118, 62, 482/1–9, 51, 54, 148, 66, 57; 601/123, 23, 601/33, 40
See application file for complete search history.

(56) References Cited

U.S. PATENT DOCUMENTS

| | | | | | |
|---|---|---|---|---|---|
| 1,820,372 | A | * | 8/1931 | Blomquist | 482/62 |
| 1,909,002 | A | * | 5/1933 | Oehlberg | 482/62 |
| 4,296,924 | A | | 10/1981 | Anzaldua et al. | 272/117 |
| 4,717,146 | A | * | 1/1988 | Nohara | 482/62 |
| 4,799,475 | A | | 1/1989 | Iams et al. | 128/25 R |
| 4,842,269 | A | | 6/1989 | Huang | 272/73 |
| 4,957,281 | A | * | 9/1990 | Christolear, Jr. | 482/100 |
| 5,178,589 | A | | 1/1993 | Wilson et al. | 482/62 |
| 5,304,108 | A | | 4/1994 | Denega et al. | 482/110 |
| 5,338,272 | A | | 8/1994 | Sweeney | 482/57 |
| 5,389,057 | A | | 2/1995 | Zagata, Jr. | 482/83 |
| 5,580,338 | A | * | 12/1996 | Scelta et al. | 482/62 |
| 6,036,624 | A | * | 3/2000 | Cascini | 482/97 |
| 6,117,093 | A | * | 9/2000 | Carlson | 601/33 |
| 6,342,033 | B1 | | 1/2002 | Walker | 482/114 |
| 6,551,214 | B1 | | 4/2003 | Taimela | 482/10 |
| 6,676,570 | B2 | * | 1/2004 | Valentino | 482/45 |
| 6,960,155 | B2 | * | 11/2005 | Chien et al. | 482/62 |
| 2003/0092539 | A1 | | 5/2003 | Wang | 482/92 |

* cited by examiner

*Primary Examiner*—Jerome Donnelly
(74) *Attorney, Agent, or Firm*—Thomas L. Adams

(57) ABSTRACT

Exercise apparatus is shown with a column attached atop a base. A junction box attached atop the column has emerging therefrom a plurality of shafts including a top shaft, a front shaft, and a pair of side shafts. One or more of the shafts offers resistance to rotation in either direction. Thus, a user can exercise by turning at least one of the plurality of shafts. For example, the top shaft can be rotated to simulate the workout associated with cranking a sailing winch. Alternatively, a crossbar attached through an arm to the front shaft can be used to rotate the front shaft during a workout. A pair of cranks may be attached to the side shafts and can be driven manually when the junction box is in a raised position, or pedally in a lowered position. In some cases the pair of pedals have substantially the same phase. Then, after separately securing a user's feet on different respective ones of the in-phase pedals, the user rotates the pedals in synchrony, by simultaneously pulling and then pushing pedally.

28 Claims, 3 Drawing Sheets

EXERCISE APPARATUS

BACKGROUND OF THE INVENTION

1. Field of the Invention

The present invention relates to exercise apparatus for strengthening and conditioning muscles, and in particular, to equipment offering a workout by allowing a user to rotate a mechanical element against resistance provided by the equipment.

2. Description of Related Art

Self-contained or compact exercise machines are highly desirable, especially if they offer interesting exercises or offer a wide variety of exercises.

Such machines ought to allow a robust workout of various muscle groups, as well as prevent boredom by giving the user an interesting workout routine.

Known exercise machines include recumbent stationary bicycles, often having electronically controlled resistance that varies according to preset workout profiles. The resistance offered by these machines may be controlled by an adjustable eddy current brake. Other known exercise machines employ a pair of hand cranks that are arranged like bicycle pedals but in an elevated position so that the user may grasp and rotate the crank against an adjustable mechanical resistance.

Sailors are often called upon to operate a manual crank to sheet in a sail or to draw in a line for some other reason. These cranking motions are often done rapidly and repeatedly, particularly when tacking upwind or racing. Unfortunately, many sailors do not sail during the winter months and may lose the muscle conditioning gained during the sailing season. Besides sailors, many individuals would benefit by an exercise routine that involved a manual cranking motion that exercises muscles in a way that is different from that offered by existing machines. Moreover, such a machine would be used more because it offers an interesting change from the conventional exercise machines.

In FIG. 1 of U.S. Pat. No. 4,957,281 a person on seat 22 can sit near a crank handle 54 with an elbow in cradle 118 to turn the crank and lift the weights 14 in order to exercise the rotator cuff. The coupler 63 on crank 52 can be attached either to horizontal shaft 76 or vertical shaft housing 68. This arrangement is safe for only fractional crank turns, since the crank would spin like a weapon if a user lost his/her grip on the crank after multiple turns. Also, resistance is offered only in one direction.

In FIG. 7 of U.S. Pat. No. 5,304,108 shaft 371 can be oriented vertically so that a user can grasp handles 354 and reciprocate them in a horizontal plane.

In U.S. Pat. No. 6,342,033 a pair of horizontal arms 21 and 22 can be fitted with a pad 24 that supports an assembly 1 having a cuff 4 that is placed at the user's arm near the elbow.

In the arm exerciser of FIG. 9 of U.S. Patent Application Publication No. 2003/0092539 a person kneels and rotates members 10 through a horizontal plane.

In U.S. Pat. No. 4,296,924 an exerciser places his/her arms in the illustrated cradles and then rotates the torso as the cradles rotate about a vertical axis.

In the arm exerciser of FIG. 6 of U.S. Pat. No. 4,799,475 a person kneels on a platform, places the hands in the rests 96 and 98, and rotates them in a horizontal plane.

In U.S. Pat. No. 6,551,214 a person exercises the neck by placing the head inside helmet 3 and rotating the helmet about a vertical axis.

In U.S. Pat. No. 5,389,057 a horizontal bar 48/54 has a weight 50 on one end and on the other end a practice target 72 that can be hit by a martial artist.

In U.S. Pat. No. 5,178,589 a crank mechanism with a horizontal axis of rotation can be placed in an upper position for arm exercises or in a lower position for leg exercises.

In U.S. Pat. No. 5,580,338 a portable exercise machine has a hand crank for arm exercises. The machine is designed to be placed on the lap with the crank axis horizontal.

In U.S. Pat. No. 5,338,272 a person on seat 18 can do arm exercises with crank 20 and leg exercises with crank 42. These cranks have a horizontal axis. See also U.S. Pat. No. 4,842,269.

See also U.S. Pat. Nos. 4,521,012; 5,709,633; 5,989,162; 6,126,580; and 6,533,708

Accordingly, there is a need for an improved exercise apparatus that offers exercises that will condition various muscle groups and will also increase the interest in exercise and avoid boredom.

SUMMARY OF THE INVENTION

In accordance with the illustrative embodiments demonstrating features and advantages of the present invention, there is provided an exercise apparatus that has a support attached atop a base. A junction box is attached atop the support. This junction box has rotatably mounted therein a top shaft adapted for multiple turns. The top shaft offers resistance to rotation in either direction. Also included is a manual crank adapted to be attached to and project above the top shaft.

In accordance with another aspect of the invention, an exercise apparatus has a support attached atop a base. A junction box attached atop the support has emerging therefrom a plurality of shafts including a top shaft, and a pair of side shafts. Thus, a user can exercise by turning at least one of the plurality of shafts.

In accordance with yet another aspect of the invention, an exercise apparatus has a support attached atop a base. A junction box attached atop the support has emerging therefrom a front shaft and a crossbar having an arm attached to the front shaft. This arm is rotatably attached to the crossbar. Thus, a user can exercise by using the crossbar to rotate the front shaft.

In accordance with still yet another aspect of the invention, an exercise apparatus has a junction box attached atop a base. A pair of pedals emerging on opposite sides of the junction box have substantially the same phase.

In accordance with still yet another aspect of the invention, an exercise apparatus has a column attached atop a base. A junction box is attached atop the column. The column is adjustable to move the junction box between a raised and a lowered position. A pair of cranks emerges on opposite sides of the junction box, and are adaptable to be driven pedally in the lowered position and manually in the raised position.

In accordance with another aspect of the invention, an exercise method is provided that employs a top shaft projecting upwardly from a junction box. The method includes the step, while seated or standing, of manually rotating the top shaft about a substantially vertical axis in one direction while mechanically resisting such rotation. Another step is, while seated or standing, manually rotating the top shaft in an opposite direction about a substantially vertical axis while mechanically resisting such rotation. These movements are done while standing or sitting.

In accordance with yet another aspect of the invention, an exercise method is provided that employs a crossbar having an arm attached to a front shaft of a junction box. The method includes the step of grasping the crossbar at about shoulder width or greater. Another step is rotating the arm and elevationally translating the crossbar while keeping the crossbar approximately level.

In accordance with still yet another aspect of the invention, an exercise method is provided that employs a pair of pedals emerging on opposite sides of a junction box at substantially the same phase. The method includes the step of separately securing a user's feet on different respective ones of the pedals.

Another step is rotating the pedals in synchrony, with the user simultaneously pulling and then pushing pedally.

By employing apparatus and methods of the foregoing type, an improved exercise routine can be achieved. In a preferred embodiment, a column mounted on a base will support a junction box from which one or more shafts emerge. For example, a top shaft can be fitted with a crank. A user can grasp and rotate the crank in either direction to experience a unique and interesting workout. This preferred junction box has a pair of adjustable braces that can be extended to secure the apparatus in, for example, a door frame.

This preferred junction box also has a pair of side shafts that can be fitted with either manual cranks or foot pedals. With the junction box in a raised position the user can manually rotate the manual cranks to achieve another type of upper body workout. Alternatively, the junction box can be lowered, and the side shafts fitted with pedals in order to use the apparatus as a recumbent bicycle. In this case the user can sit on seat that is attached to the base of the apparatus.

The foot pedals can be arranged with the usual opposite phasing, but in some embodiments they can be mounted in-phase. For that situation, the pedals are fitted with ankle bracelets to secure the feet. Thereafter, the feet can be simultaneously pushed and then pulled to exercise not only the legs but to provide a significant abdominal workout.

In still other embodiments, the front shaft on the junction box can be fitted with a manual crank or with a crossbar. This crossbar can be connected through a ball joint to an arm that attaches to the front shaft. The preferred arm can telescopically extend and contract so the user can comfortably raise and lower the crossbar in a natural elliptical pattern. The telescopic extension and retraction of the arm can be regulated pneumatically to avoid jerky motions. Also, the resistance to rotation can be reduced around the six o'clock and 12 o'clock positions where the user is then applying a sideward thrust, but using generally weaker muscles.

A braking device can be mounted in the junction box or at the base, but the base is preferred when the braking device is relatively heavy, as is normally the case when a flywheel and eddy current brake is employed. In such a case, a vertical, telescopic shaft extends from the braking device to the junction box, which may have a gear train to transfer resistance torque to the various shafts emerging from the junction box.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
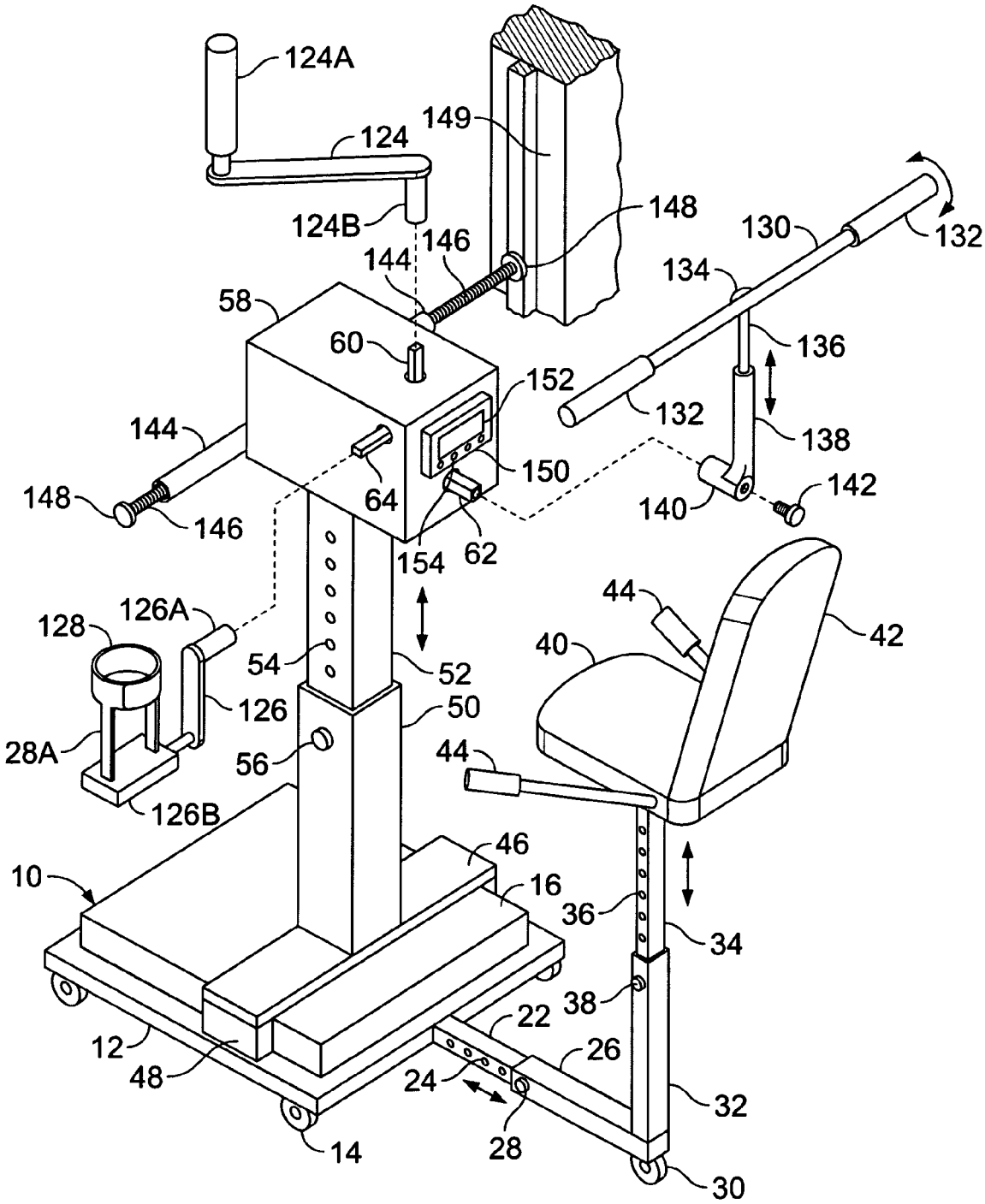
FIG. 1 is an axonometric view of an exercise apparatus in accordance with principles of the present invention.

Referring to FIG. 1, the illustrated exercise apparatus has a base 10 comprising a rectangular platform 12 with casters 14 at each corner. Platform 12 is preferably a steel shell with internal reinforcing members (not shown), but in other embodiments may be made out of the wood, plastic, composite materials, etc. Mounted on base 10 is a case 16 containing a braking device that will be described presently.

Welded transversely to the center of one edge of platform 12 is a horizontal, square tube 22 having a series of longitudinally disposed apertures 24. A larger square tube 26 is telescopically mounted around tube 22 and can be locked in position when spring-loaded plunger 28 snaps into one of the apertures 24. The distal end of tube 26 is supported by caster 30. A vertical tube 32 welded to the distal end of tube 26 telescopically receives a smaller tube 34 having a series of longitudinally disposed apertures 36. Again, a locking plunger 38 can engage one of the apertures 36 to fix the height of tube 34. A seat 40 attached to the upper end of tube 36 has a back 42 and a pair of hand grips 44 that extend from the seat 40 in a direction that is upwardly and outwardly inclined.

A beam 46 spanning case 16 is supported by a pair of legs 48 attached to the topside of platform 12. A vertical square tube 50 is attached to the center of beam 46 and telescopically receives a smaller square tube 52 having a series of longitudinally disposed apertures 54. Locking plunger 56 can engage one of the apertures 54 to fix the height of tube 52. Tubes 50 and 52 will be referred to herein as a support or column.

Mounted at the upper end of tube 52 is a junction box 58 that can be vertically adjusted by adjusting the height of tube 52. When box 58 is above (below) a halfway position it will be considered in a raised (lowered) position. In this embodiment, junction box 58 provides four shafts that may be used for exercise: top shaft 60, front shaft 62, and pair of side shafts 64. Shafts 64 emerge on opposite sides of junction box 58, although only one of the shafts is visible in FIG. 1. In this embodiment shafts 60, 62, and 64 are orthogonal and are all horizontal except for shaft 60, which is substantially vertical. It will be appreciated that other embodiments may be built that have only some of these shafts, or in some cases additional shafts.

Figure 2:
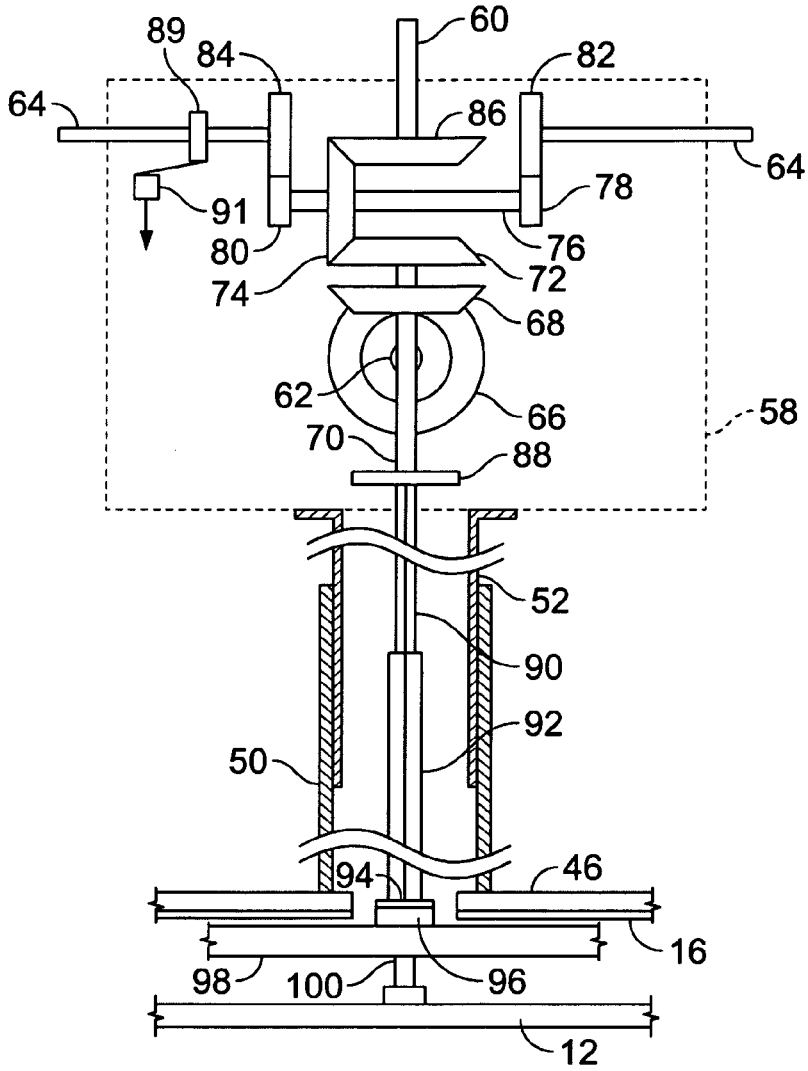
FIG. 2 is an elevational view, partly in section, of a mechanism inside the exercise apparatus of FIG. 1 with portions broken away for illustrative purposes.

Referring to FIG. 2, shafts 60, 62, and 64 are shown coupled in a gear train inside junction box 58, which may be considered as being viewed from the rear. In particular, the inside end of shaft 62 is shown attached to a bevel gear 66 that meshes with another bevel gear 68 that is mounted on vertical shaft 70. It will be appreciated that the various shafts illustrated in this Figure are supported by appropriate bearings, but that these are not shown in order to simplify this illustration. The upper end of shaft 70 is attached to another bevel gear 72 that meshes with a bevel gear 74 mounted on horizontal shaft 76. Gears 78 and 80 on opposite ends of shaft 76 mesh with gears 82 and 84, respectively, which in turn attach to previously mentioned side shafts 64. Bevel gear 74 also meshes with bevel gear 86, which attaches to previously mentioned top shaft 60.

Preferably, the gear ratios of the above train are selected so that shafts 60, 62 and 64 rotate at the same speed. It will be appreciated that in some embodiments the train may be formed with belts and pulleys, gears and chains, or with other mechanisms. Also, a multi-lobe cam on shaft 64 is used to drive microswitch 91, which acts as a sensor for producing an output signal indicating the rotation of the shaft.

If a user rotates one or more of the shafts 60, 62, and 64, then shaft 70 will turn as a result. The lower end of shaft 70 is connected through a pair of gears 88 (only one visible in this view) to a square shaft 90 (also referred to as the lower shaft) that slides telescopically inside a square tube 92 inside previously mentioned column 50, 52. The lower end of tube 92 has a flange 94 that attaches through rubber shock mount 96 to a flywheel 98 located below beam 46 and case 16. The flywheel 98 is subjacently supported by a shaft 100 that is journaled atop platform 12. Accordingly, if the user rotates of one of the shafts 60, 62, and 64 then flywheel 98 will rotate as a result.

Figure 3:
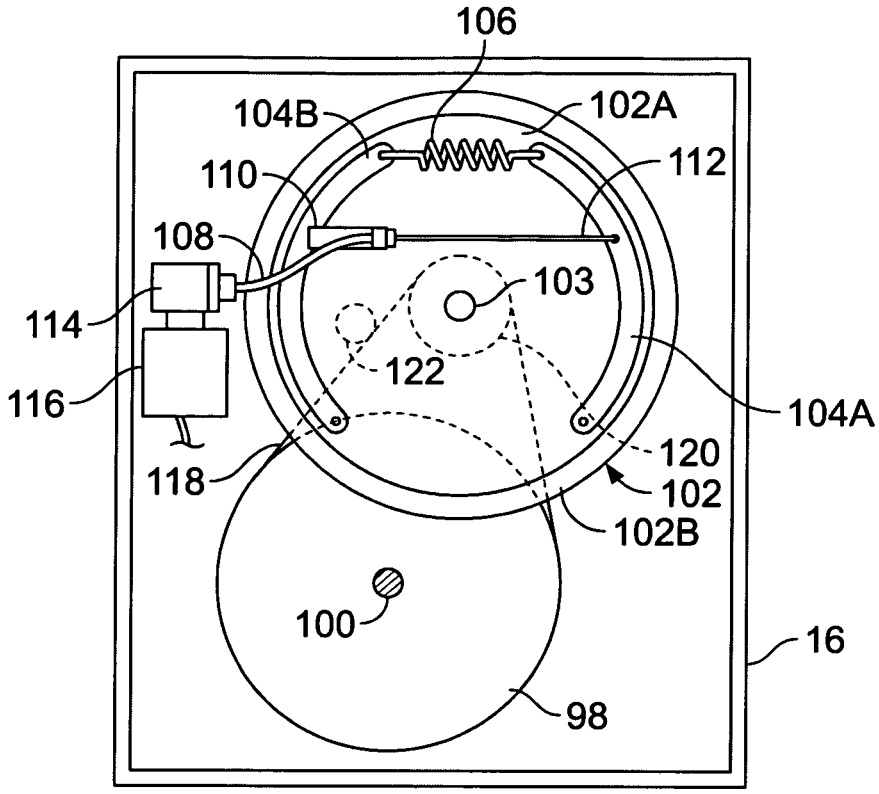
FIG. 3 is a bottom plan view of a flywheel and braking device inside the case of FIG. 1.

Referring to the bottom view of FIG. 3, previously mentioned case 16 contains an adjustable braking device shown herein as a rotor 102 comprising a disk 102A with an outer circumferential wall 102B all rotatably supported on a shaft 103 journaled on the platform (platform 12 shown in FIG. 1). The adjustable braking device also has a pair of arcuate shoes 104A and 104B each having one end tied together through a compression spring 106 that tends to drive shoes 104A and 104B against the inside of wall 102B. The ends of shoes 104A and 104B opposite spring 106 are pivotally connected to a link (not shown) that is in turn linked to platform (platform 12 of FIG. 1) so that the shoes stay in about the same azimuthal location.

A cable 108 similar to a bicycle cable (i.e., wire inside a flexible sleeve) has its distal end connected to bracket 110 mounted on shoe 104B. Extending from the distal end of cable 108 is its internal wire 112, which attaches to shoe 104A. Accordingly, when wire 112 is drawn into the sleeve of cable 108, shoes 104A and 104B are drawn together in opposition to compression spring 106. Conversely, if wire 112 is released, compression spring 106 drives shoes 104A and 104B apart. The tension on wire 112 of cable 108 is changed by a tensioning mechanism, which may be a capstan mechanism 114 driven by an electrically operated actuator 116, such as a solenoid, servomotor, etc.

Shoes 104A and 104B have a number of outside pockets containing magnets (not shown) that magnetically couple to the steel of wall 102B of rotor 102. Accordingly, as rotor 102 rotates, eddy currents are generated to resist the rotation of the rotor so that the device acts as an eddy current brake in a well-known manner. The amount of resistance can be regulated by changing the amount of separation between wall 102B and the shoes 104A and 104B, with decreasing separation causing increasing resistance and vice versa.

Previously mentioned flywheel 98 (supported on shaft 100) is shown rotatably mounted inside previously mentioned case 16. A belt 118 is wrapped around the grooved perimeter of flywheel 98 and the perimeter of a pulley 120 that is coaxially mounted on the top of rotor 102. Tension is maintained in belt 118 by a spring-biased idler 122.

Referring again to FIG. 1, the manual crank 124 has a handle 124A on one end and on the other end a socket 124B designed to fit over top shaft 60. Socket 124B may lock onto top shaft 60 with a spring biased detent, a bayonet coupling, a transverse cotter pin, a separate screw fastener, etc. Alternatively, socket 124B may lock onto front shaft 62, or onto side shaft 64. In the latter case two manual side cranks will be employed.

Figure 5:
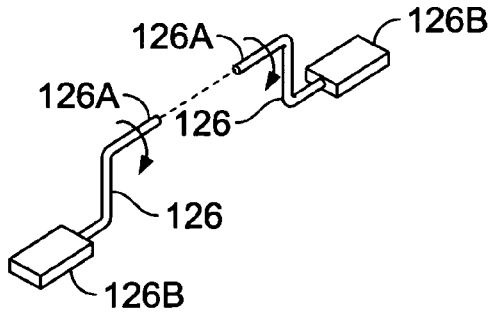
FIG. 5 is an axonometric, free body diagram of in-phase pedals that may be used with the apparatus of FIG. 1.

In some instances, pedals (also referred to as side cranks) will be attached to side shafts 64. In some cases the pedals will be installed out of phase (that is, crank arms spaced 180° and extending in opposite directions). In other cases, the pedals will be installed in-phase; that is, extending in the same direction as shown in FIG. 5.

Pedal 126 is designed for such in-phase positioning (but can still be used for out-of-phase pedaling). Pedal 126 has a socket 126A designed to lock onto side shafts 64 as well as a foot platform 126B of the usual type. An ankle bracelet 128 is shown as a belt that can be closed with a hook and loop or other types of fasteners. Straps 128A depending from the ankle bracelet 128 attach to the platform 126B. Accordingly, the ankle bracelet can be opened and then closed around a user's ankle to allow the user to push and pull on the pedal 126. Instead of ankle bracelets some embodiments will use the known clipless bicycle pedals that are designed to snap onto cycling shoes fitted with mating metal cleats.

A crossbar 130 that may be about four feet (1.2 m) long has swivel handles 132 at either end. The center of crossbar 130 connects through a ball joint 134 to arm 136, which can telescopically reciprocate inside a cylindrical sleeve 138. This reciprocation is pneumatically regulated in a manner much like a pneumatic screen door closer (except the present device is not spring biased into a neutral or collapsed position). The proximal end of sleeve 138 is attached to a socket 140 that is designed to fit onto shaft 62 and be secured in place by a bolt 142.

Because junction box 58 will often sustain lateral thrust, especially from shafts 60 and 62, adjustable braces are provided in the form of an internally threaded sleeve 144 shown extending horizontally from opposite sides of the back of box 58. The sleeve 144 may be a single sleeve or pair of sleeves. Threaded into sleeve 144 as part of the brace is a threaded shaft 146 having at its distal end a pad 148. Pad 148 is shown braced against the stop of a door jamb 149.

Electronic module 150 is mounted on the front of junction box 58, although it can be mounted in other positions in different embodiments. Module 150 is shown with an LCD screen 152 and a number of input pushbuttons 154.

Figure 4:
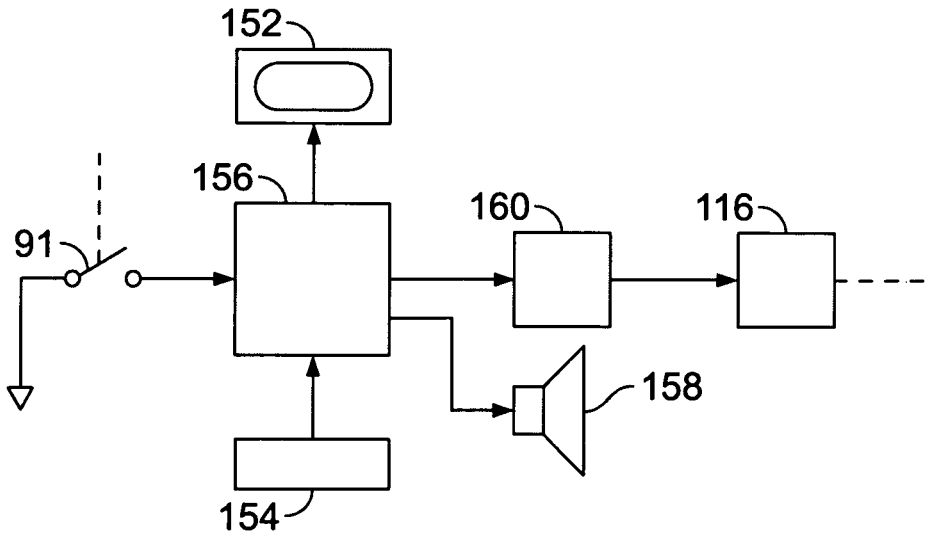
FIG. 4 is a schematic diagram of a controller associated with the apparatus of FIG. 1.

Referring to FIG. 4, previously mentioned LCD screen 152 and push buttons 154 are shown connected to a controller 156. The controller 156 may be a commercially available microcomputer or microcontroller. The controller 156 is shown with another input, namely, previously mentioned shaft sensor 91, which is shown connected between an input of controller 156 and ground. An output of controller 156 is shown connected to a loudspeaker 158, which may produce audible warnings, announcements, and in some embodiments sailing sound effects of a type to be described presently. Another output of controller 156 is connected through a converter 160 to the previously mentioned actuator (actuator 116 of FIG. 3). The converter 160 may be a digital to analog converter or other signal conditioning device appropriate for driving the actuator 116. Devices 152, 158, and 160 are herein referred to as output devices.

To facilitate an understanding of the principles associated with the foregoing apparatus, its operation will be briefly described. As shown in FIG. 1, a user may roll the illustrated device into a doorway and extend threaded shafts 146 and brace them against nearby structure, such as opposing door jambs 149. Thereafter manual crank 124 may be installed on top shaft 60 and manually rotated as the user stands or sits on seat 40. If the user wishes to stand, it may be convenient to remove seat 40 by detaching tube 26 from tube 22. Although the user may vigorously turn crank 124 the device will not fall since it is braced by elements 144, 146, and 148.

Alternatively, the user may place a pair of manual cranks on side shafts 64 or a single crank on front shaft 62.

The user may set program module 150 on the front of box 58 to initiate a computer-guided workout. For example, the user may select sailing simulation. In that case the intensity of the workout offered to the user on display screen 152 can be stated in terms of wind forces: for example, light breeze, fresh breeze, strong wind, gale force, or hurricane. After making such a selection, the user will be prompted by an announcement generated by controller 156 (FIG. 104) and displayed on screen 152 asking the user to turn the crank 124 on shaft 60 in a clockwise (or counterclockwise) direction. As a user proceeds, fractional revolutions of shaft 60 will be sensed by sensor 91, which will periodically close to send a pulse signal to controller 156.

The controller 156 will send a gradually varying command signal to actuator 160, causing capstan 114 (FIG. 3) to gradually release wire 112 and bring shoes 104A and 104B closer to steel wall 102A of rotor 102, thereby gradually increasing the resistance to rotation of flywheel 98. This resistance is transferred through shafts 92 and 90 (FIG. 2) to the lower shaft 70 of the gear train in junction box 58. Consequently, an increasing resisting force will be applied to the top shaft 60 as the user continues to crank. This increasing resistance simulates the increasing resistance a sailor experiences when sheeting in a sail.

Controller 156 will await a predetermined number of revolutions (e.g. 20 turns) and then issue an announcement through screen 152 instructing the user to reverse direction. Simultaneously, controller 156 will issue a command signal through converter 160 (FIG. 4) that causes actuator 116 to tighten wire 112 (FIG. 3) to pull shoes 104A and 104B away from wall 102B, thereby decreasing the resistance. In some embodiments controller 156 will have an additional sensor to verify that the user has in fact reversed direction.

Thereafter, the user will then proceed to turn the crank 124 as the resistance gradually increases as before. This cycle of clockwise and counterclockwise rotations will repeat for a preset number of times that the user has selected depending upon the desired vigor of the workout.

During this workout, controller 156 can issue appropriate sailing sound effects to speaker 158, such as the sound of wind or the sound a ratchet makes during cranking.

The total elapsed time or the elapsed time of certain intervals will be recorded in controller 156 so at the end of the workout the user can be given a performance report on screen 152. This report may compare the just completed performance to some predetermined standard, to the user's best previous performance, or to the performance of other users.

In some cases, user will wish to use the more traditional exercise profiles typically associated with stationary exercise bicycles. For example, the user can be directed to maintain a specified angular velocity while the resistance will change over time (or according to the number of revolutions completed). The resistance profile can also be selected by the user to be constant, changing randomly, peaks and valleys, a gradual warmup followed by gradual cooldown, a cardiovascular profile, a fat burning profile, etc.

In fact, a user may actually use these more traditional resistance profiles while using the apparatus as a stationary recumbent bicycle. In this case, junction box 58 will be lowered from the illustrated raised position that would be convenient for operating manual cranks. In particular, the plunger 56 can be withdrawn in order to lower junction box 58 by telescopically collapsing tubes 50 and 52, while shaft 90 collapses into tube 92.

The pedals 126 can then be installed on shafts 64 either in-phase as shown in FIG. 5 or out of phase (i.e., phased 180° apart and extending in opposite directions). Ankle bracelets 128 will be important for in-phase pedaling since the user must be able to simultaneously pull on both pedals while seated on seat 40. Since the user's ankles are secured to the pedal platform 126B the pulling operation can be performed while the user's feet remain at the pedals. It should be noted that during the pulling operation the user will workout the abdominal muscles.

If the user now wishes to use crossbar 130 (FIG. 1) socket 140 can then be attached to shaft 62 and held in place with bolt 142. The user may wish to remove seat 40 as described previously and stand upright. With the rod 136 at the three o'clock position the user may decide to rotate the device clockwise (although rotation in either direction is allowed). From this position the user's arms will be partially curled and will be extended to push down, so that rod 136 will gradually extend from sleeve 138.

As the user approaches the six o'clock position the user's arms are extended but must now shift to the left. Since relatively weaker muscles are used in this shifting motion, controller 156 can compensate for this condition by responding to the closure of switch 91 (FIG. 4) that is phased to occur in some range around the six o'clock position. In particular, controller 156 will issue a command through converter 160 causing actuator 116 to tighten wire 112 (FIG. 3). Consequently, shoes 104A and 104B will separate from the rotor wall 102B to reduce the resistance.

Once past this six o'clock interval, the user will now lift crossbar 130, first curling the arms and then extending them overhead, as the rod 136 initially retracts and then extends. When nearing the 12 o'clock position sensor 91 again closes so that the controller 156 can respond as before and reduce the resistance from the braking device of FIG. 3. Once past the 12 o'clock region the user now pulls down on crossbar 130 with arms initially outstretched overhead. Upon reaching the three o'clock position the cycle can be repeated. The user can reverse the rotation direction as desired or according to instructions from electronic module 150.

It will be appreciated that the foregoing routine provides a wide variety of successive exercises that are similar to a tricep extension, a bicep curl, a military press, and a lat pulldown. Also, the fact that the crossbar 130 is connected by a universal joint 134 requires the user to exercise using balancing adjustments that are akin to the type of workout produced by free weights.

It is appreciated that various modifications may be implemented with respect to the above described, preferred embodiment. For example, the braking device may be mounted inside the junction box. In some instances where the braking device is inside the junction box, the box will only have a pair of opposing shafts but the box will be mounted on gimbals to orient the shafts up and down, right and left, or front and back. While an eddy current brake is shown, some embodiments may use a frictional belt wrapped around a flywheel, disk brakes with calipers, etc. In some embodiments the system may be operated hydraulically with hydraulic devices providing resistance, and adjustment of the resistance being performed by hydraulic valves. Also, some embodiments may not have any electronic controller and the amount of resistance can be manually set to a constant amount by adjusting an appropriate knob or the like. Also, some embodiments may be used without lateral braces where the base is relatively heavy or is fastened to the floor. Moreover, various components can be made of metals, ceramics, plastics, composite materials or other appropriate substances, depending on the desired strength, weight, rigidity, etc. Also, the size, shape and dimensions of the various components can be adjusted depending upon the size of the individual, the space available, aesthetic reasons, etc.

Obviously, many modifications and variations of the present invention are possible in light of the above teachings. It is therefore to be understood that within the scope of the appended claims, the invention may be practiced otherwise than as specifically described.

The invention claimed is:

1. Exercise apparatus comprising:

a base;

a support attached atop said base;

a junction box attached atop said support, said junction box having rotatably mounted therein a top shaft adapted for multiple turns, said top shaft offering resistance to rotation in either direction;

a manual crank adapted to be attached to and project above said top shaft;

an adjustable braking device coupled to said top shaft for resisting rotation thereof;

a controller coupled to said adjustable braking device for controlling it and regulating resistance of said top shaft according to a program; and a sensor coupled to said top shaft for sensing turning thereof, said controller being operable to vary the resistance of said top shaft in response to turning of said top shaft as sensed by said sensor.

2. Exercise apparatus according to claim 1, comprising:

a pair of side shafts rotatably mounted in said junction box, said side shafts being mechanically coupled to turn in unison with said top shaft.

3. Exercise apparatus according to claim 1 comprising:

a pair of adjustable braces attached to and extending from opposite sides of said junction box for engaging nearby structures and laterally stabilizing said junction box.

4. Exercise apparatus according to claim 1 comprising:

a seat attached to said base.

5. Exercise apparatus according to claim 1 wherein said junction box has rotatably mounted therein a front shaft that is mechanically coupled to turn in unison with said top shaft.

6. Exercise apparatus according to claim 1 comprising:

an output device coupled to said controller, said controller being operable to count revolutions of said top shaft and (a) increase resistance of said top shaft according to a predetermined schedule, and (b) upon said top shaft completing a preset number of revolutions (i) setback resistance of said top shaft, and (ii) send a signal through said output device signifying an instruction to reverse the direction of rotation of said top shaft.

7. Exercise apparatus according to claim 6 wherein said controller is operable to record a user's performance in terms of speed or time elapsed to complete a predetermined number of revolutions and display through said output device a signal comparing the users performance to a preset standard.

8. Exercise apparatus according to claim 7 wherein said controller is operable to provide through said output device a sailing sound effect.

9. Exercise apparatus according to claim 1 wherein said junction box has emerging therefrom a front shaft, said apparatus comprising:

a crossbar having an arm attached to said front shaft, so that a user can exercise by using said crossbar to rotate said front shaft.

10. Exercise apparatus according to claim 2 comprising a plurality of side cranks adapted to be removably attached to said side shafts.

11. Exercise apparatus according to claim 10 wherein some of said side cranks are adapted to be driven manually and some are adapted to be driven pedally.

12. Exercise apparatus according to claim 11 wherein said support is adjustable to move said junction box between a raised and a lowered position, those of said side cranks adapted to be driven pedally being mountable and rotatable on said side shafts when said junction box is in said lowered position.

13. Exercise apparatus according to claim 2 comprising:

a pair of pedals emerging on opposite sides of said junction box, said pedals having substantially the same phase.

14. Exercise apparatus according to claim 13 wherein said pedals each comprise:

an ankle bracelet for allowing a user to pull said pedal.

15. Exercise apparatus according to claim 9 wherein said arm is connected to said crossbar with a ball joint.

16. Exercise apparatus according to claim 9 wherein said arm is operable to telescopically reciprocate.

17. Exercise apparatus according to claim 16 wherein telescopic reciprocation of said arm is pneumatically regulated.

18. Exercise apparatus according to claim 9 comprising:

a controller coupled to said arm to modulate resistance to rotation thereof by decreasing resistance around a 12 o'clock and 6 o'clock position.

19. Exercise apparatus comprising:

a base;

a support attached atop said base, said support including a column;

a junction box attached atop said support, said junction box having rotatably mounted therein a top shaft adapted for multiple turns, said top shaft offering resistance to rotation in either direction;

a manual crank adapted to be attached to and project above said top shaft; and an adjustable braking device mounted at said base below said column, said braking device being coupled to said top shaft for adjustably resisting rotation of said top shaft, said adjustable braking device comprising an eddy current brake including a rotor with a vertical axis and a radially adjustable shoe.

20. Exercise apparatus according to claim 19 comprising:

a pair of adjustable braces attached to and extending from opposite sides of said junction box for engaging nearby structures and laterally stabilizing said junction box.

21. Exercise apparatus according to claim 19 wherein said junction box has a lower shaft, said apparatus comprising:

a pair of side shafts rotatably mounted in said junction box, said side shafts being mechanically coupled to turn in unison with said top shaft, said adjustable braking device being coupled to said lower shaft, said lower shaft being coupled to said top shaft and said pair of side shafts for resisting rotation of said top shaft and said pair of side shafts.

22. Exercise apparatus according to claim 21 wherein said junction box has a plurality of bevel gears interlinking said lower shaft with said top shaft and said pair of side shafts.

23. Exercise apparatus according to claim 19 comprising:

an electrically operated actuator coupled to said shoe for adjusting resistance by said eddy current brake.

24. Exercise apparatus according to claim 23 comprising:

a flywheel with a vertical axis coupled between said top shaft and said rotor.

25. Exercise apparatus according to claim 19 wherein said junction box has emerging therefrom a pair of side shafts, so that a user can exercise by turning at least one of said plurality of shafts.

26. Exercise apparatus according to claim 19 wherein said junction box having emerging therefrom a front shaft said apparatus comprising:

a crossbar having an arm attached to said front shaft, said arm being rotatably attached to said crossbar, so that a user can exercise by using said crossbar to rotate said front shaft.

27. Exercise apparatus according to claim 19 comprising:

a pair of pedals emerging on opposite sides of said junction box, said pedals having substantially the same phase.

28. Exercise apparatus according to claim 19 wherein said column is adjustable to move said junction box between a raised and a lowered position, said apparatus comprising:

a pair of cranks emerging on opposite sides of said junction box, said cranks being adaptable to be driven pedally in the lowered position and manually in the raised position.

* * * * *